United States Patent [19]

Joshi et al.

[11] Patent Number: 4,903,760

[45] Date of Patent: Feb. 27, 1990

[54] INTEGRAL OIL COOLER AND RADIATOR TANK

[75] Inventors: Shrikant M. Joshi, Getzville; Lee C. Whitehead, Middleport, both of N.Y.

[73] Assignee: General Motors Corporation, Detroit, Mich.

[21] Appl. No.: 356,101

[22] Filed: May 24, 1989

[51] Int. Cl.[4] ..... F01P 11/08

[52] U.S. Cl. ..... 165/41; 165/51; 165/140; 165/169; 165/905; 165/716; 123/41.33; 123/196 AB; 184/104.1

[58] Field of Search ..... 165/41, 51, 140, 173, 165/916, 169, 905; 123/196 AB, 41.33; 184/104.1, 104.3

[56] References Cited

U.S. PATENT DOCUMENTS

| | | | |
|---|---|---|---|
| 1,948,929 | 2/1934 | MacPherson | 165/140 |
| 2,013,708 | 9/1935 | Bianchi et al. | 165/140 |
| 3,116,541 | 1/1964 | Nickol et al. | 165/140 |
| 3,126,942 | 3/1964 | Tyler | 165/140 |
| 3,265,126 | 8/1966 | Donaldson | 165/140 |
| 4,651,821 | 3/1987 | Moranne | 165/173 |
| 4,709,757 | 12/1987 | Bly | 165/173 |
| 4,834,171 | 5/1989 | Larrabee et al. | 165/140 |

FOREIGN PATENT DOCUMENTS

| | | | |
|---|---|---|---|
| 2353362 | 5/1975 | Fed. Rep. of Germany | 165/173 |
| 1168798 | 7/1986 | Japan | 165/173 |

*Primary Examiner*—John Ford

*Attorney, Agent, or Firm*—Ronald L. Phillips

[57] ABSTRACT

A one-piece combination radiator tank and oil cooler for an automotive vehicle comprises a molded polymer structure of double wall construction such that the space between the walls is an oil cooler reservoir which shares a common wall with the coolant reservoir of the radiator tank. The heat from the oil reservoir is transferred to the coolant reservoir. Heat transfer across the common wall is enhanced by using high surface area shapes and by using surface features that promote good heat transfer. The inlet and outlet fittings are also molded polymer. The whole assembly is molded as one piece or as a very few pieces which are bonded together.

3 Claims, 1 Drawing Sheet

INTEGRAL OIL COOLER AND RADIATOR TANK

FIELD OF THE INVENTION

This invention relates to a vehicle radiator with an integral oil cooler and particularly to a polymer radiator tank including an oil cooler.

BACKGROUND OF THE INVENTION

In automotive vehicles it is common practice to cool the engine by pumping hot engine coolant through a radiator which dissipates heat to ambient air. Such radiators have efficient metallic tube and fin structures for transmitting heat to the air, and reservoirs or tanks for coupling the coolant between the radiator hoses and the tubes. The tanks may be metal but polymeric materials have become increasingly more common in usage.

In many cases the engine lubricating oil or the transmission oil also is cooled. A variety of cooling practices have been used such as separate heat exchangers for the oil or some combination of the oil and coolant heat exchange function. Many vehicles employ an oil cooler which resides within the radiator tank to effect heat transfer from the oil to the engine coolant. The size and complexity of the latter type of oil cooler varies according to the required thermal capacity but, in general, they are brazed assemblies built up of tubes and fins having inlets and outlets extending through fittings in the radiator tank. Such structures have many parts and are thus expensive to manufacture, and they increase the size and complexity of the radiator tank.

SUMMARY OF THE INVENTION

It is therefore an object of the invention to provide an oil cooler in a radiator without complex structure. It is another object to provide an oil cooler integral with a radiator.

The invention is carried out in an automotive radiator having a heat exchanger core and polymer tanks for coupling coolant flow between hoses and the heat exchanger core, means for cooling oil comprising: a polymer shell defining a tank and an enclosed oil passage, a coolant fitting carried by the shell, the shell having an outer wall and a common wall spaced from the outer wall, the common wall having a periphery in fluid tight relationship to the outer wall to define the enclosed oil passage wherein the common wall separates the passage from the tank, and means for enhancing thermal coupling through the common wall so that hot oil in the passage can be cooled by coolant flowing through the tank.

BRIEF DESCRIPTION OF THE DRAWINGS

The above and other advantages of the invention will become more apparent from the following description taken in conjunction with the accompanying drawings wherein like references refer to like parts and wherein.

DESCRIPTION OF THE PREFERRED EMBODIMENT

Figure 1:
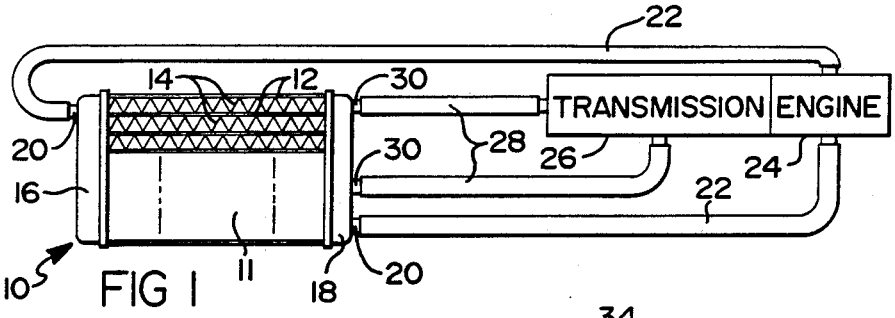
FIG. 1 is a schematic diagram of an engine cooling system with oil cooling.

Referring to FIG. 1, a radiator 10 comprises a conventional heat exchanger core 11 including tubes 12 carrying coolant and fins 14 between the tubes for dissipating heat from the tubes to the ambient air. At each end of the heat exchanger core 11, a tank 16 and a combination tank/cooler 18 provide reservoirs of coolant coupled to the tube 12 ends and have inlet and outlet fittings 20 for connection to radiator hoses 22. The hoses lead to an engine 24 so that heat can be carried by the coolant from the engine to the radiator 10. A transmission 26 is coupled by hoses 28 to fittings 30 on the tank/cooler 18 for circulation of transmission oil to the tank/cooler 18 for cooling the oil. Of course engine oil can be cooled in the same manner instead of or in addition to the transmission oil. In the latter case, the tank 16 could also be a combination tank/cooler.

Figure 2:
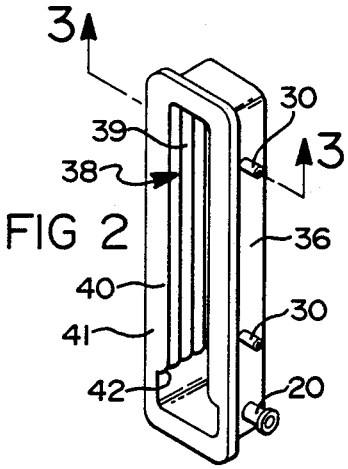
FIG. 2 is an isometric view of a combination radiator tank and oil cooler according to the invention.
Figure 3:
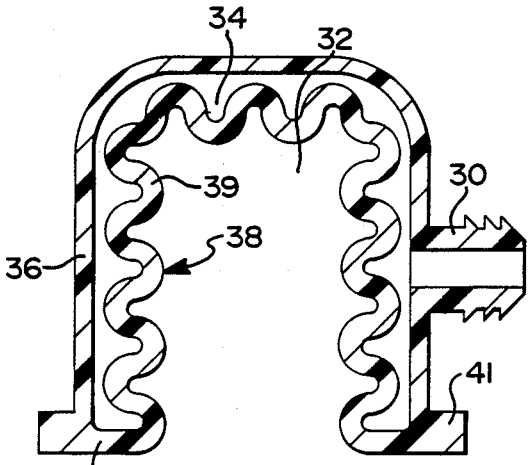
FIG. 3 is a cross section of the combination radiator tank and oil cooler taken along line 3—3 of FIG. 2.

The tank structure for cooling the oil is shown in isometric view in FIG. 2 and in cross section in FIG. 3. Essentially the tank/cooler 18 is a double walled structure or shell defining a coolant reservoir 32 with an open side for coupling to the heat exchanger core 11 and an enclosed oil reservoir 34. The shell comprises an outer wall 36 and a common wall 38. The common wall has a body portion 39 which is spaced from the outer wall and a periphery 40 that joins the outer wall at a peripheral flange 41 for at least a portion of the tank periphery and at a joint 42 at a place spaced from an end of the tank to provide a single wall region for accommodating the coolant fitting 20. The flange 41 seals against the core 11. Thus the common wall as well as a portion of the outer wall in the region of the fitting 20 defines the coolant reservoir. Moreover, the space between the body portion 39 and the outer wall 36 defines the oil passage or reservoir 34.

Figure 4:
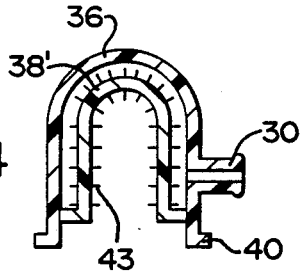
FIG. 4 is a cross section of a second embodiment of a combination radiator tank and oil cooler according to the invention.

The common wall 38 between the coolant reservoir 32 and the oil reservoir 34 allows heat transfer from the oil to the coolant. To enhance heat transfer the body portion 39 of the common wall is formed with undulations or convolutions which increase surface area without increasing wall thickness. Many other shapes for maximizing surface area are possible. In addition, heat transfer is facilitated by surface roughness or surface features which cause turbulence in the fluid flowing across the surface. Such surface features are indicated in FIG. 4 which has projections 43 on each side of the common wall 38'. The projections 43 may take the form of fins, bumps, ribs or vanes, for example. In the FIG. 4 example the common wall lacks the undulations which increase the surface area. The decision of whether to design increased surface area into the common wall depends on the thermal requirements of the oil cooler and the heat transfer capacity available without the increased area.

Figure 5:
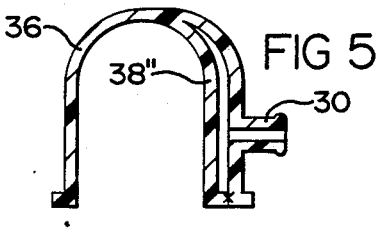
FIG. 5 is a cross section of a third embodiment of a combination radiator tank and oil cooler according to the invention.

In the embodiment of FIG. 5 the common wall 38" is coextensive with one half of the outer wall 36 so that the double wall structure is limited to only that half. Again the heat transfer needs determine the suitability of that design. It has the advantage of ease of manufacture.

Figure 6A:
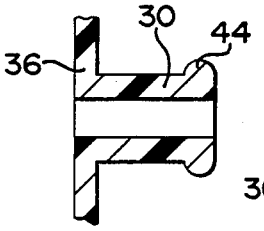
FIGS. 6*a*, 6*b* and 6*c* are three embodiments of inlet and outlet fittings for an oil cooler according to the invention.
Figure 6B:
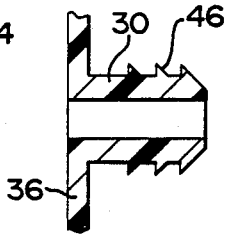
Figure 6C:
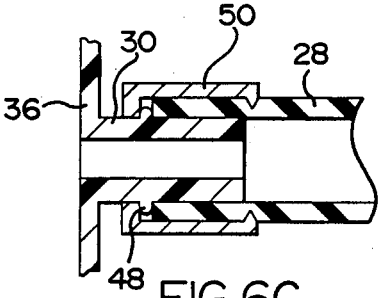

Inlet and outlet fittings 30 for coupling the oil reservoir to the hoses 28 are integral with the outer wall 36. Preferably these are molded into the wall or formed when the wall is molded. FIG. 6*a* shows a nipple or fitting 30 extending from the wall 36 and has a bead 44 around its end to help hold a hose 28 in place. FIG. 6*b* shows molded barbs 46 around a nipple 30 for the same purpose. FIG. 6*c* has a bead 48 formed near the base of the nipple 30. This cooperates with a flanged clamp or ring 50 to secure the hose 28 to the nipple 30.

Conventional tanks are commonly molded of a glass reinforced nylon about 0.1 inch thick. This material or other polymers may be used for the combination tanks/oil coolers described herein. Where possible the entire unit is molded in one piece. In many cases it will be preferred to make components and assemble them by bonding or fusion. For example the common wall 38" of FIG. 5 may be molded separately from the outer wall and then assembled. The fittings also may be made separately. Adhesives are appropriate for joining the components but ultrasonic welding is preferred in some instances. In any event the number of parts for an oil cooler is greatly reduced. A brazed tube and fin structure requires many parts compared to the common wall of the present invention which requires one part if it is not molded as part of the outer wall. A fitting conventionally requires three machined metal parts contrasted with one molded part.

It will thus be seen that the present invention affords economies of manufacture of oil coolers by combining them with radiator tanks in a manner to use common structural portions and in addition greatly reduces the number of parts needed for an oil cooler. Light weight and corrosion proof materials provide further benefits.

The embodiments of the invention in which an exclusive property or privilege is claimed are defined as follows:

1. An integral molded oil cooler and coolant tank for an automotive radiator comprising a singular polymer shell having an outer wall exposed to the ambient environment and a common wall with internal and external sides located interior of and extending along a predetermined portion of said outer wall, said common wall having a body portion spaced from said outer wall and a periphery extending completely thereabout integral with the periphery of said predetermined portion of said outer wall whereby said walls cooperatively define an open sided coolant reservoir between said external side of said body portion and the region of said outer wall outside said predetermined portion and whereby said walls also cooperatively define an enclosed oil reservoir between said internal side of said body portion and said predetermined portion of said outer wall, an oil inlet fitting and an oil outlet fitting open to said oil reservoir at opposite ends thereof formed integral with said predetermined portion of outer wall, a coolant fitting open to said coolant reservoir formed integral with said outer wall in said region outside said predetermined portion, and said body portion having an undulating cross sectional shape to maximize the surface area of both said internal side and said external side.

2. The integral molded oil cooler and coolant tank as defined in claim 1 wherein said oil fittings have a bead formed integral therewith for retaining a hose.

3. The integral molded oil cooler and coolant tank as defined in claim 1 wherein said oil fittings have barbs formed integral therewith for retaining a hose.

* * * * *